US009515410B2

(12) United States Patent
Tanikawa

(10) Patent No.: US 9,515,410 B2
(45) Date of Patent: Dec. 6, 2016

(54) CONNECTOR WITH A SLIDER RELEASABLY LOCKED TO A HOUSING BY A RESILIENT STOPPER HAVING TWO POINTS OF SUPPORT FOR RESILIENT DEFLECTION

(71) Applicant: Sumitomo Wiring Systems, Ltd., Yokkaichi, Mie (JP)

(72) Inventor: Naotaka Tanikawa, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 14/787,010

(22) PCT Filed: May 8, 2013

(86) PCT No.: PCT/JP2013/062975

§ 371 (c)(1),
(2) Date: Oct. 26, 2015

(87) PCT Pub. No.: WO2014/181414

PCT Pub. Date: Nov. 13, 2014

(65) Prior Publication Data

US 2016/0104965 A1 Apr. 14, 2016

(51) Int. Cl.
*H01R 13/514* (2006.01)
*H01R 13/502* (2006.01)
(Continued)

(52) U.S. Cl.
CPC ..... *H01R 13/502* (2013.01); *H01R 13/4368* (2013.01); *H01R 13/641* (2013.01)

(58) Field of Classification Search
CPC ..... H01R 13/4223; H01R 13/4361; H01R 13/4362; H01R 13/4365; H01R 13/4368; H01R 13/62; H01R 13/6272; H01R 13/6639; H01R 13/639; H01R 13/641; H01R 13/7032
USPC ..... 439/752, 352, 354, 489
See application file for complete search history.

(56) References Cited

U.S. PATENT DOCUMENTS 6,280,237 B1 * 8/2001 Saka ..... H01R 13/4361 439/271
6,558,206 B1 * 5/2003 Machida ..... H01R 13/4368 439/595

(Continued)

FOREIGN PATENT DOCUMENTS

EP 0981185 A2 2/2000
EP 1083639 A1 3/2001

(Continued)

OTHER PUBLICATIONS

International Search Report.

(Continued)

*Primary Examiner* — Chandrika Prasad
(74) *Attorney, Agent, or Firm* — Gerald E. Hespos; Michael J. Porco; Matthew T. Hespos

(57) ABSTRACT

In the process of connecting first and second housings (10, 90), a slider (60) is kept at an advanced position by locking a resilient stopper (76) and a stopper receiving portion (25), and springs (80) accumulate spring forces. The resilient stopper (76) and the stopper receiving portion (25) are released as the housings (10, 90) are connected and the slider (60) is moved to a retracted position while being biased by the springs (80). The resilient stopper (76) projects from a base end (52) to a tip (51) and has a first support (54) at the base end (52) to function as a support of deflection when starting deflection in the process of connecting the first and second housings (10, 90) and a second support (58) closer to the tip (51) than the base end (52) to function as a support of deflection following the first support (54).

7 Claims, 13 Drawing Sheets

(51) Int. Cl.
*H01R 13/436* (2006.01)
*H01R 13/641* (2006.01)

(56) References Cited

U.S. PATENT DOCUMENTS 6,626,702 B2 * 9/2003 Kurimoto ..... H01R 13/4364 439/595
6,638,109 B2 * 10/2003 Kurimoto ..... H01R 13/4362 439/595
6,644,996 B2 * 11/2003 Yamashita ..... H01R 13/641 439/352
6,692,288 B2 * 2/2004 Nimura ..... H01R 13/641 439/352
6,793,513 B2 * 9/2004 Shibata ..... H01R 13/6272 439/271
2001/0001750 A1 5/2001 Kawase
2001/0023154 A1 9/2001 Kashiyama
2002/0155746 A1 * 10/2002 Simpson ..... H01R 13/627 439/357
2009/0149054 A1 6/2009 Zheng

FOREIGN PATENT DOCUMENTS

EP 1128486 A2 8/2001
EP 1 703 599 9/2006
JP 2000-77138 3/2000
JP 2006-86087 3/2006
JP 2006-253073 9/2006
JP 2009-140675 6/2009

OTHER PUBLICATIONS

European Search Report Dated Mar. 9, 2016.

* cited by examiner

CONNECTOR WITH A SLIDER RELEASABLY LOCKED TO A HOUSING BY A RESILIENT STOPPER HAVING TWO POINTS OF SUPPORT FOR RESILIENT DEFLECTION

BACKGROUND

1. Field of the Invention

The present invention relates to a connector.

2. Description of the Related Art

A connector disclosed in Japanese Unexamined Patent Publication No. 2000-77138 includes first and second housings connectable to each other, a slider assembled with the first housing movably between an advanced position and a retracted position, and a coil spring interposed between the slider and the first housing. The second housing includes a releasing portion (called a "front end edge of a male housing" in Japanese Unexamined Patent Publication No. 2000-77138). Further, the first housing includes a stopper receiving portion (called a "hooking portion" in Japanese Unexamined Patent Publication No. 2000-77138) and the slider includes a resilient stopper (called a "holding arm" in Japanese Unexamined Patent Publication No. 2000-77138) capable of resiliently locking the stopper receiving portion.

In the process of connecting the first and second housings, the resilient stopper and the stopper receiving portion are locked, whereby the slider is kept at the advanced position and, in that state, the slider receives a spring force of the coil spring in a compressed state and the spring force is accumulated in the coil spring. On the other hand, when the first and second housings are properly connected, the resilient stopper is pushed by the releasing portion to be lifted up in a direction to release locking with the stopper receiving portion and, associated with that, the spring force of the coil spring is released to move and bias the slider toward the retracted position. Thus, by visually confirming that the slider has reached the retracted position, it can be known that the first and second housings are in a properly connected state.

In the case of the above conventional connector, if locking between the resilient stopper and the stopper receiving portion should be accidentally released in the process of connecting the first and second housings, the slider is moved to the retracted position by the spring force of the coil spring, causing a problem of impairing the reliability of connection detection. If a reaction force of the resilient stopper is increased in view of this, it becomes difficult to release locking between the resilient stopper and the stopper receiving portion. Thus, it is possible to avoid an inadvertent movement of the slider as described above. However, if a shear area of the entire resilient stopper is increased to increase the reaction force of the resilient stopper, the resilient stopper is enlarged, consequently increasing the size of the connector.

The present invention was completed based on the above situation and aims to increase a reaction force of a resilient stopper while avoiding the enlargement of a connector.

SUMMARY

The present invention is directed to a connector with a second housing including a releasing portion, a first housing connectable to the second housing and including a stopper receiving portion, a slider assembled with the first housing movably between an advanced position and a retracted position. The connector further includes a resilient stopper resiliently lockable to the stopper receiving portion and configured so that the slider is kept at the advanced position by locking the resilient stopper and the stopper receiving portion in the process of connecting the first and second housings. The resilient stopper is deflected and deformed in a direction to release locking with the stopper receiving portion by being engaged with the releasing portion as the first and second housings are connected properly, thereby permitting a movement to the retracted position. A spring is configured to accumulate a spring force while applying the spring force to the slider kept at the advanced position in the process of connecting the first and second housings and moves the slider toward the retracted position by the release of the spring force as the first and second housings are connected properly. The resilient stopper is cantilevered from a base end portion toward a tip portion and the tip portion is lockable to the stopper receiving portion. The resilient stopper includes a first support formed at the base end portion functioning as a support of deflection when starting deflection in the process of connecting the first and second housings and a second support functioning as a support of deflection following the first support in a part closer to the tip portion than the base end portion.

When the resilient stopper starts to be deflected, the base end portion of the resilient stopper first defines the supporting point of deflection as the first support and, subsequently, the part of the resilient stopper closer to the tip portion than the base end portion defines the supporting point of deflection as the second support. Thus, a reaction force of the resilient stopper is larger than when the supporting point of deflection is formed only at the first support since the resilient stopper includes the second support. In addition, since the supporting point of deflection is not formed only of the second support, a shear area of the entire resilient stopper need not be increased and the enlargement of the connector can be avoided.

The second support may be a protrusion projecting on the resilient stopper. Thus, the structure of the resilient stopper is not particularly complicated.

The second housing includes a lock, and the first housing includes a resilient lock arm that is lockable to the lock when the first and second housings are connected properly. The protrusion is separated from the lock arm when the resilient stopper starts to be deflected in the process of connecting the first and second housings and contacts the lock arm to form the second support immediately before the first and second housings reach a properly connected state. In the process of connecting the first and second housings, the protrusion is separated from the lock arm except immediately before the first and second housings reach the properly connected state. Thus, an increase of connection resistance can be suppressed and connection operability can be improved.

A rear end part of the lock arm is pushed down toward a deflection space when releasing the connected state of the first and second housings, and the protrusion is capable of regulating the deflection of the lock arm by entering the deflection space on the side of the rear end part of the lock arm at the retracted position. This regulation of the deflection of the lock arm by the protrusion when the first and second housings are in the properly connected state prevents the first and second housings from being separated inadvertently.

The lock arm is a cantilever configured to be deflected and deformed with an arm support as a supporting point, and the protrusion comes into contact with the lock arm at a position near the arm support to form the second support. Since the lock arm is deflected and deformed in the process of connecting the first and second housings, the protrusion is unlikely to contact the lock arm in motion and it is difficult to form the second supporting point portion. However, if the protrusion comes into contact with the lock arm at the position near the arm supporting point portion, a positional variation of the lock arm is small and the second support can be formed easily as compared with the case where the protrusion contacts the lock arm at a position distant from the arm support.

DETAILED DESCRIPTION

Figure 1:
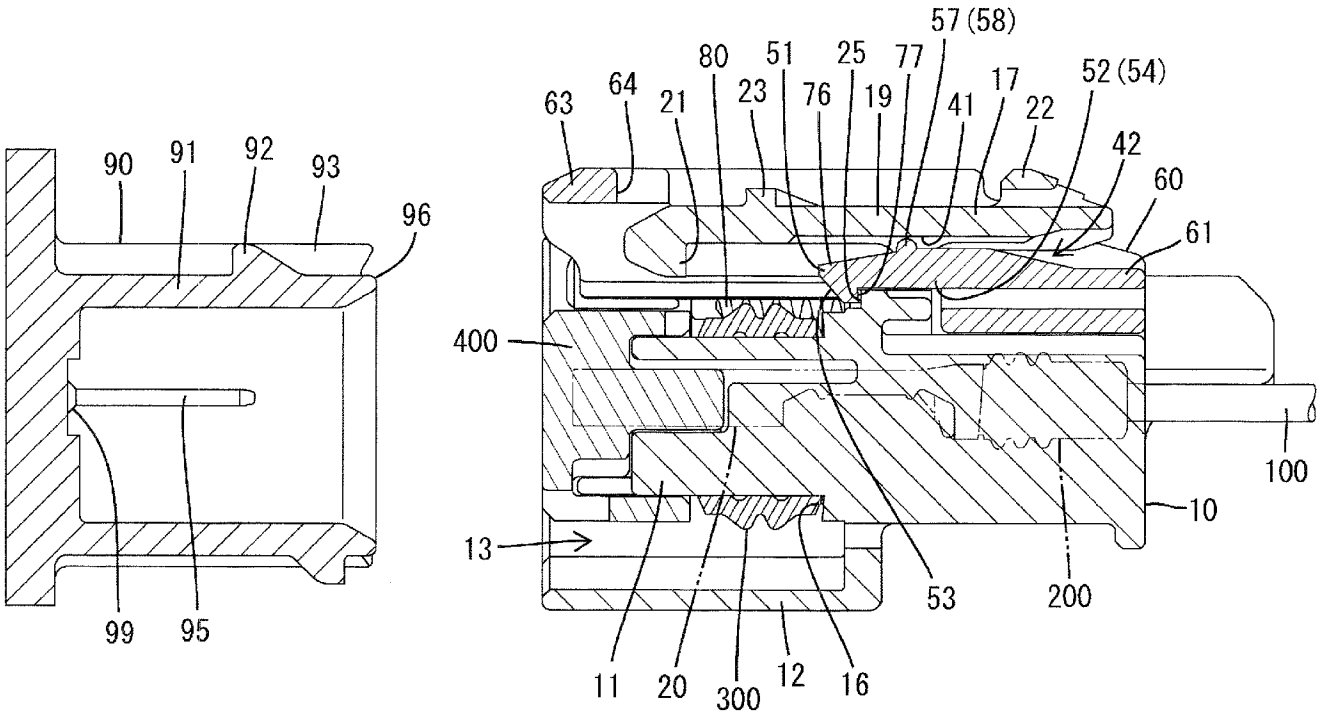
FIG. 1 is a section showing a state where first and second housings are arranged right opposite to each other in one embodiment.

One embodiment of the present invention is described with reference to FIGS. 1 to 13. This embodiment includes first and second housings 10, 90 connectable to each other, a slider 60 to be assembled with the first housing 10, spring members 80 to be assembled with the slider 60, first terminal fittings 20 to be mounted into the first housing 10 and second terminal fittings 99 to be mounted into the second housing 90. Note that, in the following description, connection surface sides of the first and second housings 10, 90 are referred to as front sides concerning a front-back direction and a vertical direction is based on FIG. 1.

Figure 4:
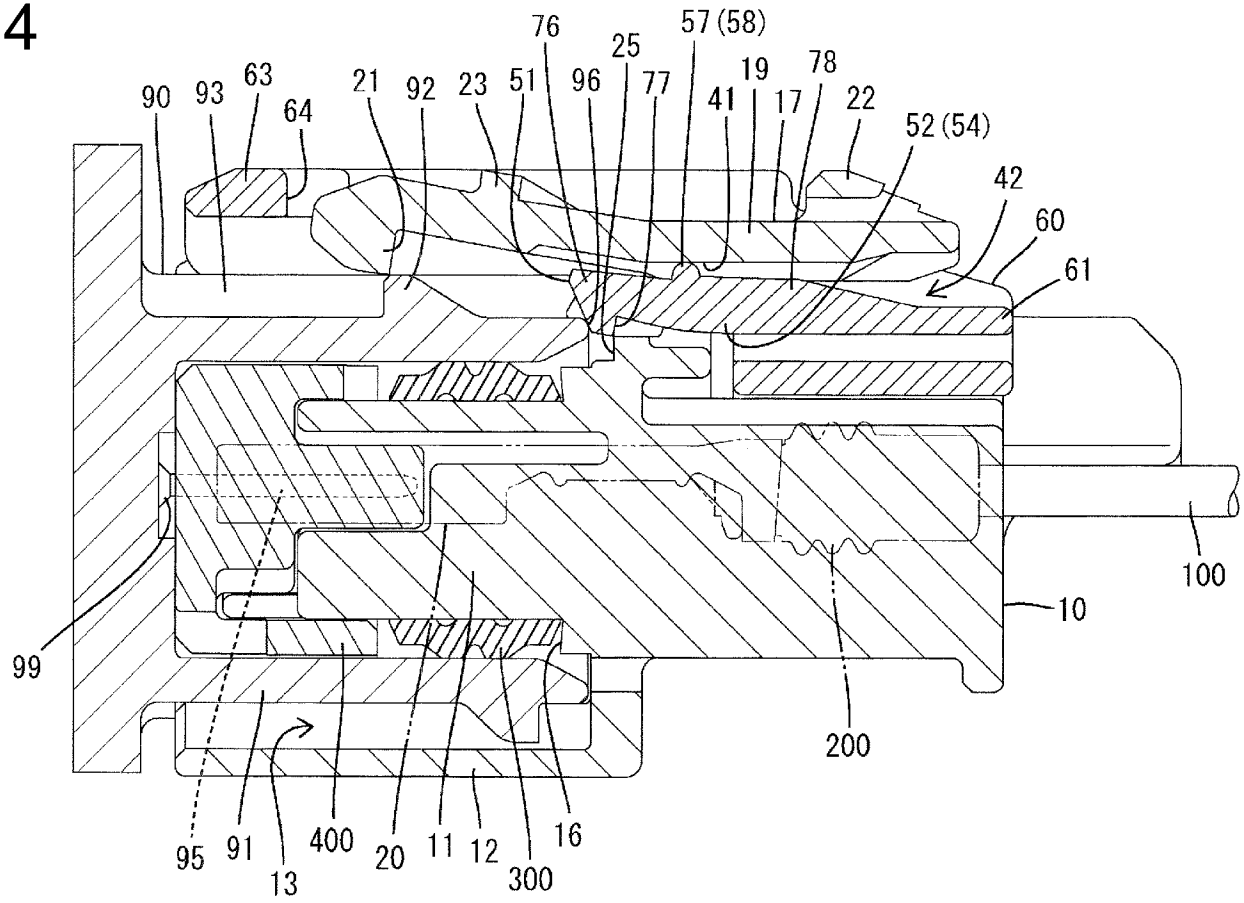
FIG. 4 is a section showing a state where the resilient stopper is deflected and deformed with a second supporting point portion as a supporting point immediately before the first and second housings are properly connected.
Figure 6:
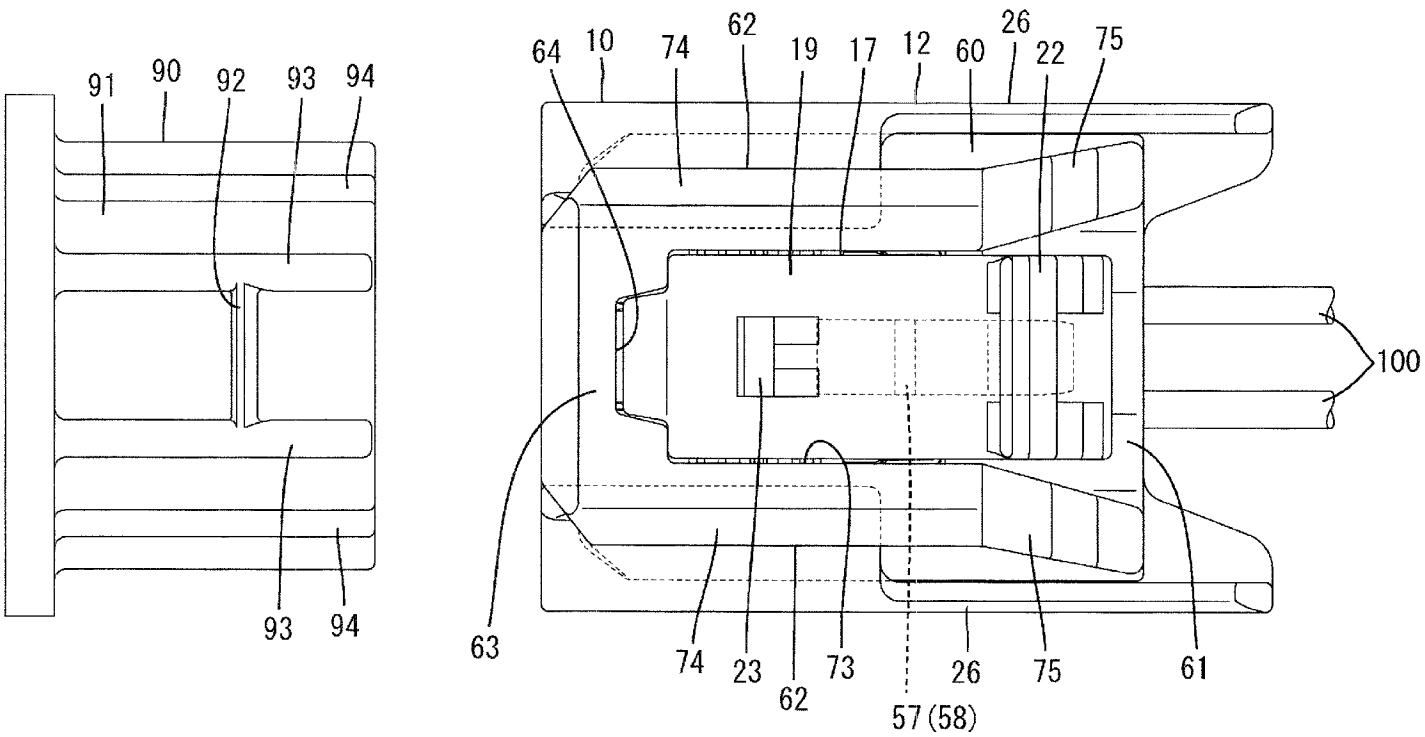
FIG. 6 is a plan view showing the state where first and second housings are arranged right opposite to each other.

The second housing 90 is made of synthetic resin and includes, as shown in FIG. 1, a tubular receptacle 91. Tabs 95 of the second terminal fittings 99 are arranged to project into the receptacle 91. A lock portion 92 is provided to project on the upper surface of the upper wall of the receptacle 91. Further, as shown in FIG. 6, a pair of guide projections 93 are formed to extend in the front-back direction at opposite widthwise sides of the lock portion 92 on the upper surface of the upper wall of the receptacle 91 and, further, a pair of pressing portions 94 are formed to extend in the front-back direction at opposite outer sides of the both guide projections 93. As shown in FIG. 4, a releasing portion 96 capable of releasing locking between a resilient stopper 76 and a stopper receiving portion 25 to be described later is formed on the opening edge of the front end of the upper wall of the receptacle 91.

Figure 8:
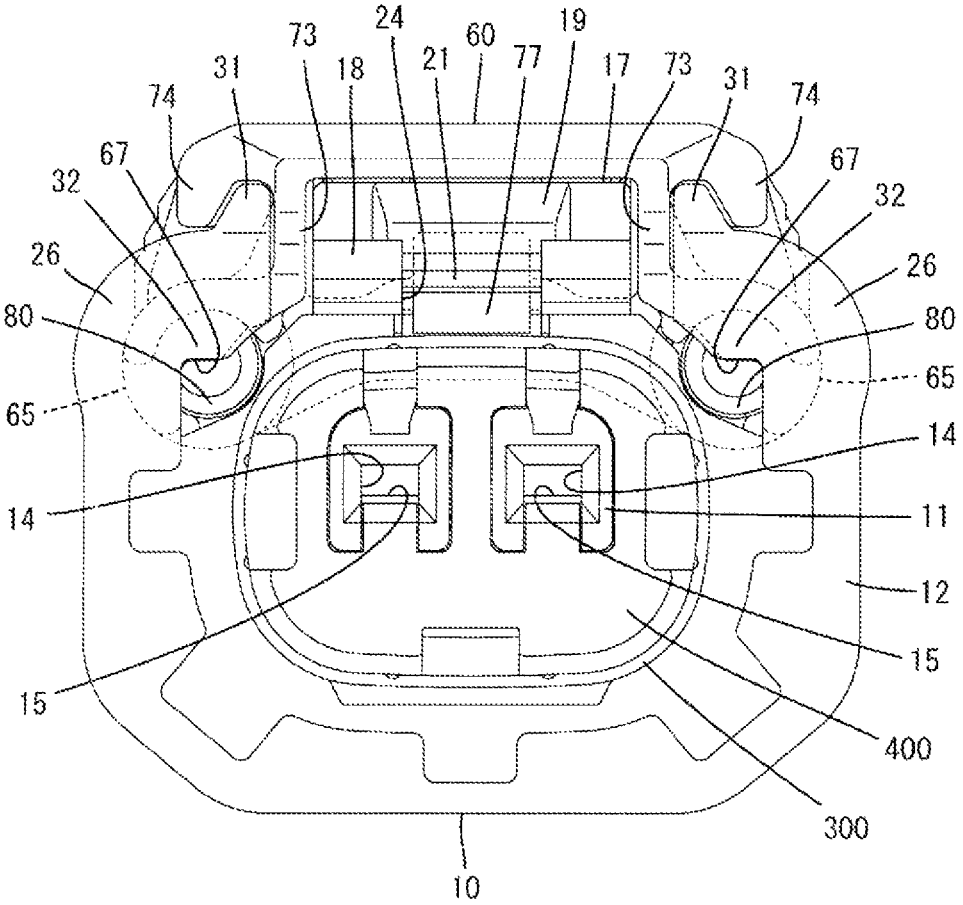
FIG. 8 is a front view of the first housing with which a slider supporting spring members is assembled.

The first housing 10 is likewise made of synthetic resin and includes, as shown in FIGS. 1 and 8, a block-like housing main body 11 and a tubular fitting tube portion 12 surrounding the housing main body 11. A connection space 13 into which the receptacle 91 is fittable is formed to be open forward between the housing main body 11 and the fitting tube portion 12. A plurality of cavities 14 are formed to penetrate through the housing main body 11 in the front-back direction. In the case of this embodiment, as shown in FIG. 8, a pair of cavities 14 are arranged side by side and deflectable locking lances 15 are formed to project on the lower surfaces of the cavities 14. The first terminal fitting 20 is inserted into each cavity 14. As shown in FIG. 1, the first terminal fitting 20 is crimped and connected to a conductor part of a wire 100 and crimped and connected to a rubber plug 200 fitted on the wire 100. When being properly inserted into each cavity 14, the first terminal fitting 20 is resiliently locked and retained by the locking lance 15, the rubber plug 200 is inserted into a rear end part of the cavity 14 to seal the interior of the cavity 14 in a liquid-tight manner and the wire 100 is drawn out from the rear end of the housing main body 11.

Figure 2:
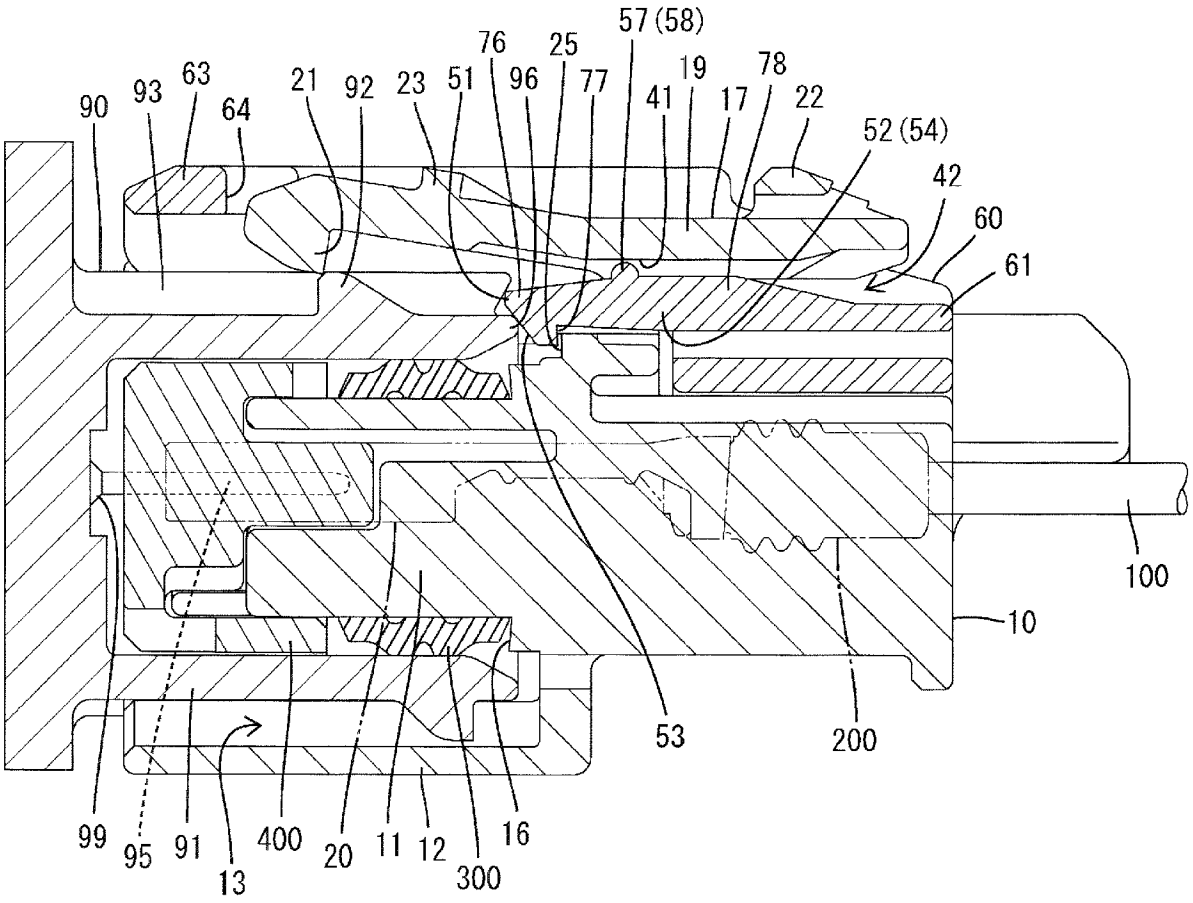
FIG. 2 is a section showing a state where a releasing portion comes into contact with a resilient stopper and the resilient stopper is deflected and deformed with a first supporting point portion as a supporting point in the process of connecting the first and second housings.

As shown in FIG. 1, a step 16 is formed on the outer peripheral surface of the housing main body 11 and a front area before the step 16 is slightly recessed from a rear area behind the step 16. A seal ring 300 is fitted before the step 16 on the outer peripheral surface of the housing main body 11. As shown in FIG. 2, the receptacle 91 is inserted into the connection space 13 and the seal ring 300 is resiliently compressed between the receptacle 91 and the housing main body 11 at the time of connecting the first and second housings 10, 90, thereby sealing between the first and second housings 10, 90 in a liquid-tight manner.

As shown in FIGS. 1 and 8, a cap-like front member 400 is mounted on a front end part of the outer peripheral surface of the housing main body 11. The above seal ring 300 is prevented from coming out forward by the front member 400.

Further, a lock arm 17 is coupled to the upper end of the outer peripheral surface of the housing main body 11 as shown in FIG. 1. As shown in FIG. 8, the lock arm 17 includes an arm supporting point portion 18 standing upward from the outer peripheral surface of the housing main body 11 and an arm main body 19 extending both forward and backward from the upper end of the arm supporting point portion 18. As shown in FIG. 1, a lock projection 21 is formed to project downward on a front end part of the arm main body 19 and a releasing portion 22 is formed to be slightly higher on a rear end part of the arm main body 19.

Further, a recess 41 is formed at a position on the side of the arm supporting point portion 18 on the lower surface of the arm main body 19. The recess 41 is a shallow recess extending in the front-back direction and open on the rear end, and has a flat bottom surface with which a protrusion 57 to be described later can come into contact.

Figure 3:
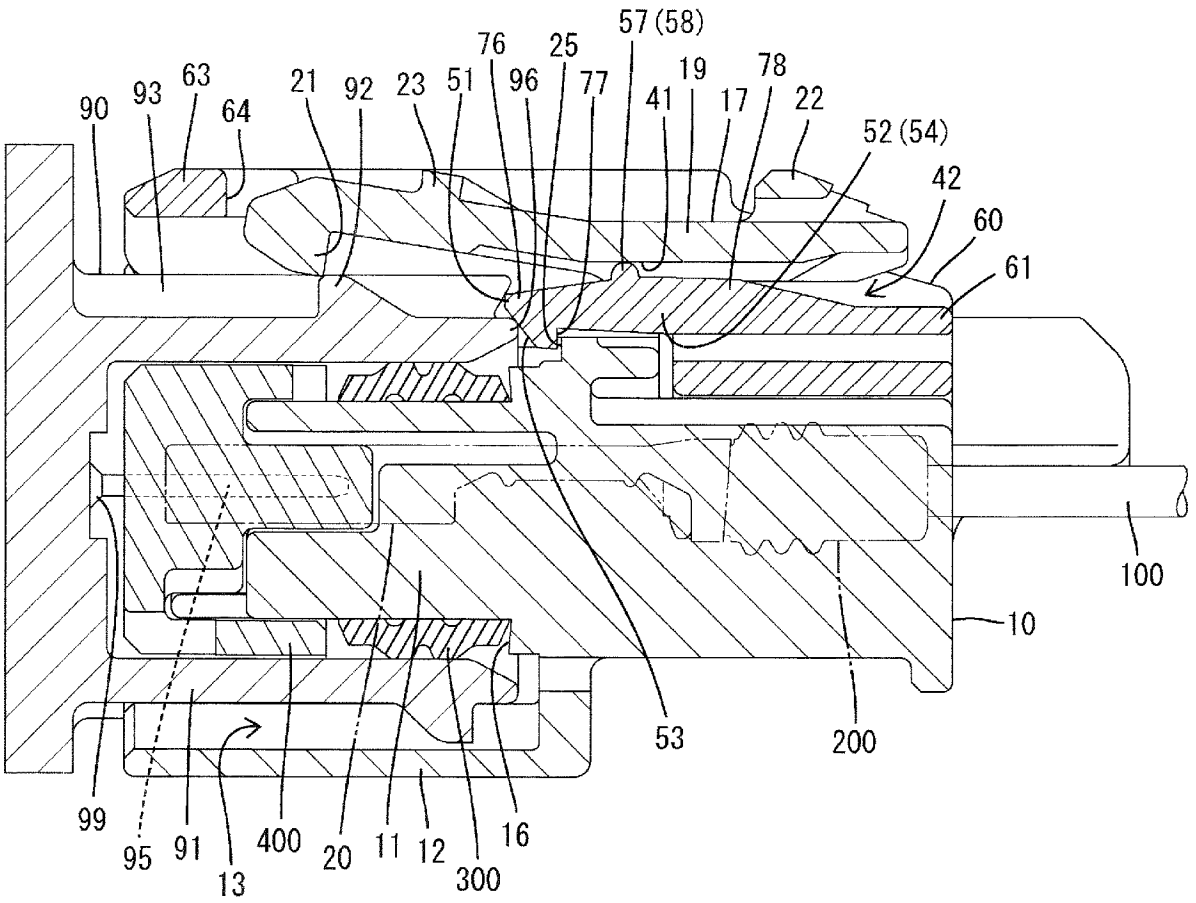
FIG. 3 is a section showing a state where a protrusion comes into contact with a lock arm in the process of connecting the first and second housings.
Figure 5:
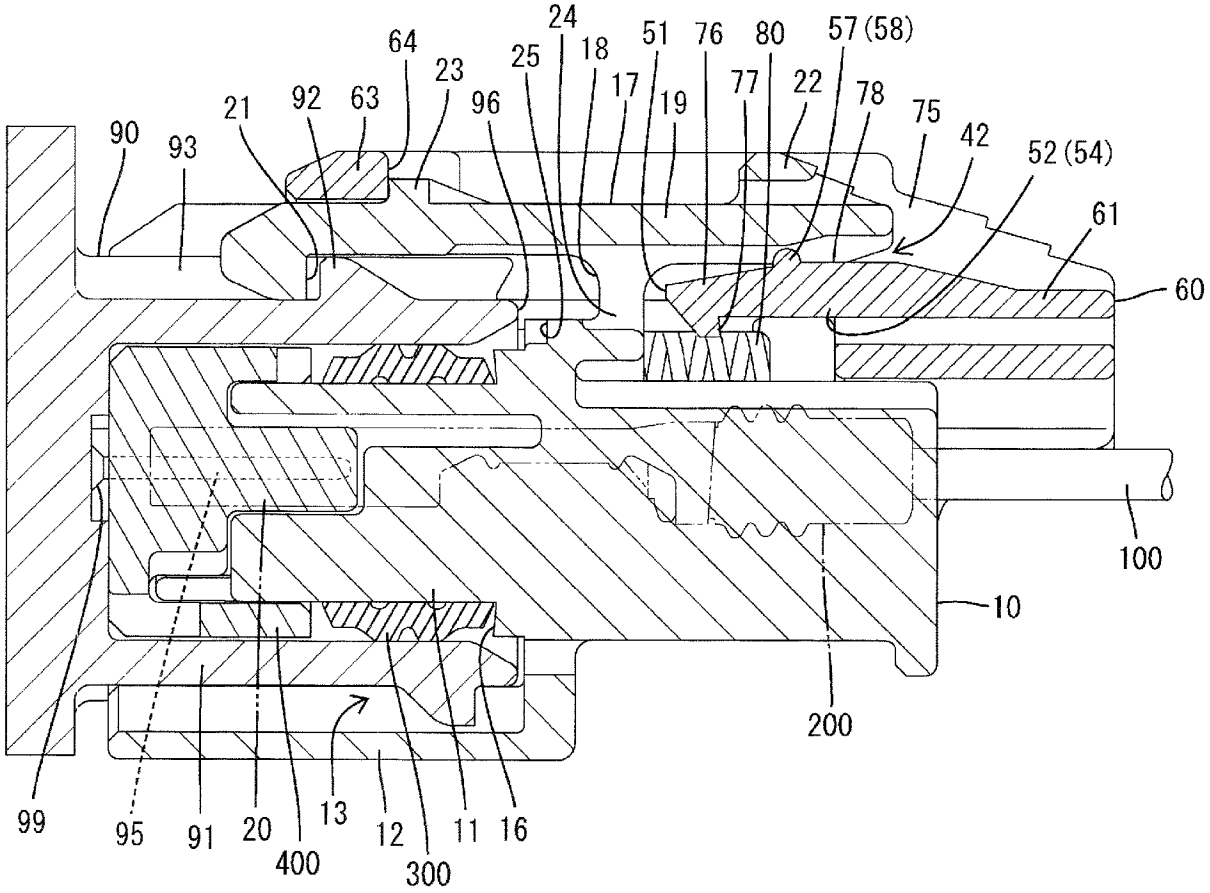
FIG. 5 is a section showing a state where the first and second housings are properly connected to each other.

As shown in FIGS. 2 to 4, the lock projection 21 interferes with the lock portion 92 and the arm main body 19 is deflected and deformed with the arm supporting point portion 18 as a supporting point in the process of connecting the first and second housings 10, 90. When the first and second housings 10, 90 are properly connected as shown in FIG. 5, the arm main body 19 resiliently returns, the lock projection 21 is arranged to be able to lock the lock portion 92 and the first and second housings 10, 90 are held in a connected state. On the other hand, in releasing the connected state of the first and second housings 10, 90, the releasing portion 22 is pushed down toward a deflection space 42 (see FIG. 1) located therebelow to separate the lock projection 21 from the lock portion 92 with the slider 60 pushed forward and retracted from the deflection space 42, whereby the first and second housings 10, 90 can be pulled apart from each other.

Figure 9:
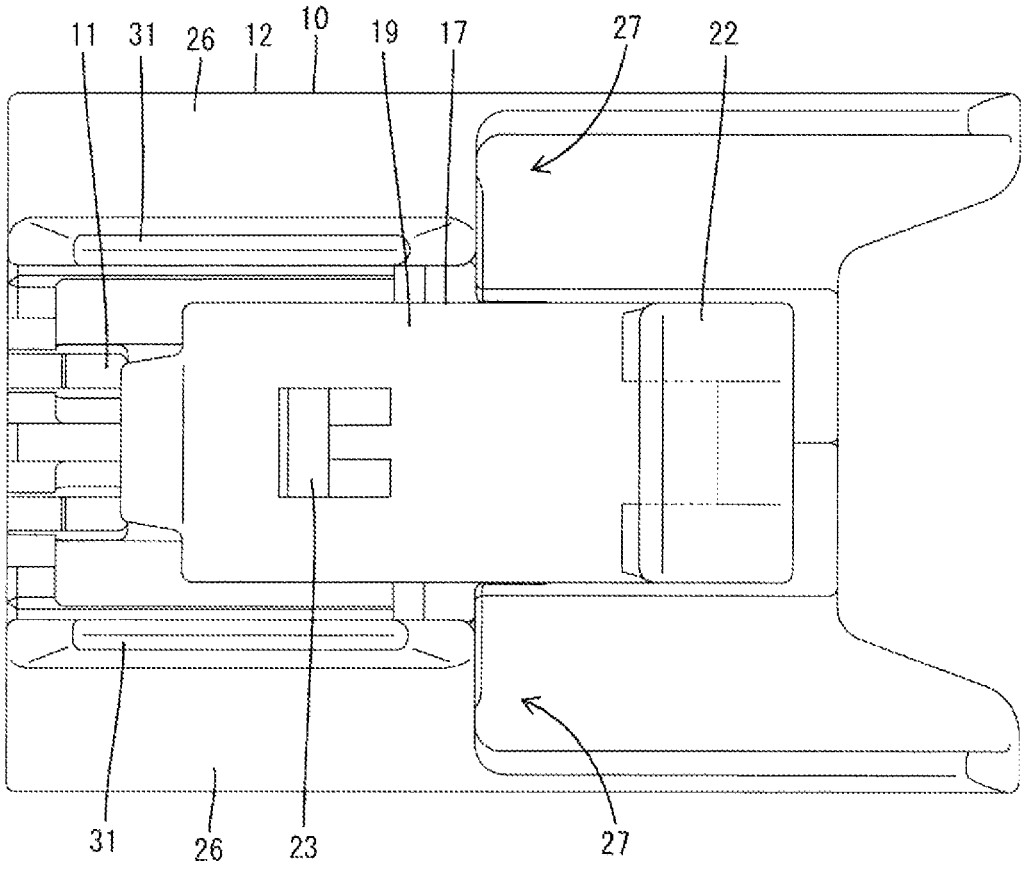
FIG. 9 is a plan view of the first housing.

Further, as shown in FIGS. 1 and 9, a retaining portion 23 for regulating a backward detachment of the slider 60 is formed on a front end part of the upper surface of the arm main body 19. The retaining portion 23 is in the form of a rib extending in a width direction. Further, as shown in FIG. 8, a through hole 24 is formed in a widthwise central part of the arm supporting point portion 18. As shown in FIG. 5, the stopper receiving portion 25 stepped from the upper surface of the housing main body 11 is formed below the through hole 24 on the arm supporting point portion 18 and behind the step 16. The later-described resilient stopper 76 of the slider 60 can pass through the through hole 24 and, as shown in FIG. 1, a later-described locking projection 77 formed on a tip portion 51 of the resilient stopper 76 passed through the through hole 24 is lockable to the stopper receiving portion 25.

As shown in FIG. 9, a part of the upper wall of the fitting tube portion 12 facing the lock arm 17 is open and the upper surface of the lock arm 17 is exposed. Here, the upper wall of the fitting tube portion 12 includes a pair of guide walls 26 at opposite sides of the lock arm 17. The both guide walls 26 extend backward from the front end of the housing main body 11 and a guide space 27 for guiding a movement of the slider 60 is formed by the both guide walls 26 and the housing main body 11.

Rear parts of the both guide walls 26 have a substantially quarter-circular arcuate cross-section open upward and project further backward than the rear end of the housing main body 11. Front parts of the both guide walls 26 have a substantially quarter-circular arcuate cross-section open on a side facing the lock arm 17. As shown in FIGS. 8 and 9, a pair of guide ribs 31 are formed to stand on the front parts of the both guide walls 26. The both guide ribs 31 extend in the front-back direction along the inner edges of the both guide walls 26 and are arranged at positions facing opposite widthwise ends of a front part of the arm main body 19.

Further, as shown in FIG. 8, a pair of stopper walls 32 for closing a front side of the guide space 27 are formed to protrude on the front ends of the both guide walls 26. Further, a pair of inner guide walls (not shown) are formed to extend backward on the lower ends of the both stopper walls 32. The inner guide walls are arranged substantially parallel to the guide walls 26. Front parts of later-described spring accommodating portions 65 of the slider 60 are guidably inserted between the inner guide walls and the guide walls 26. Further, the front ends of the spring accommodating portions 65 of the slider 60 come into contact with the stopper walls 32, thereby regulating any further forward movement of the slider 60.

Next, the slider 60 is described. The slider 60 is inserted into the guide space 27 of the first housing 10 and assembled with the first housing 10 movably in the front-back direction between an advanced position (position shown in FIGS. 1 to 4, 6 and 8) and a retracted position (position shown in FIGS. 5 and 7) while sliding on the guide walls 26. Specifically, the slider 60 is made of synthetic resin and includes a base portion 61 in the form of a plate piece extending along the width direction, a pair of arm portions 62 extending forward from opposite widthwise ends of the base portion 61 and a coupling portion 63 bridged between the front ends of the both arm portions 62 as shown in FIGS. 10 to 13.

Figure 7:
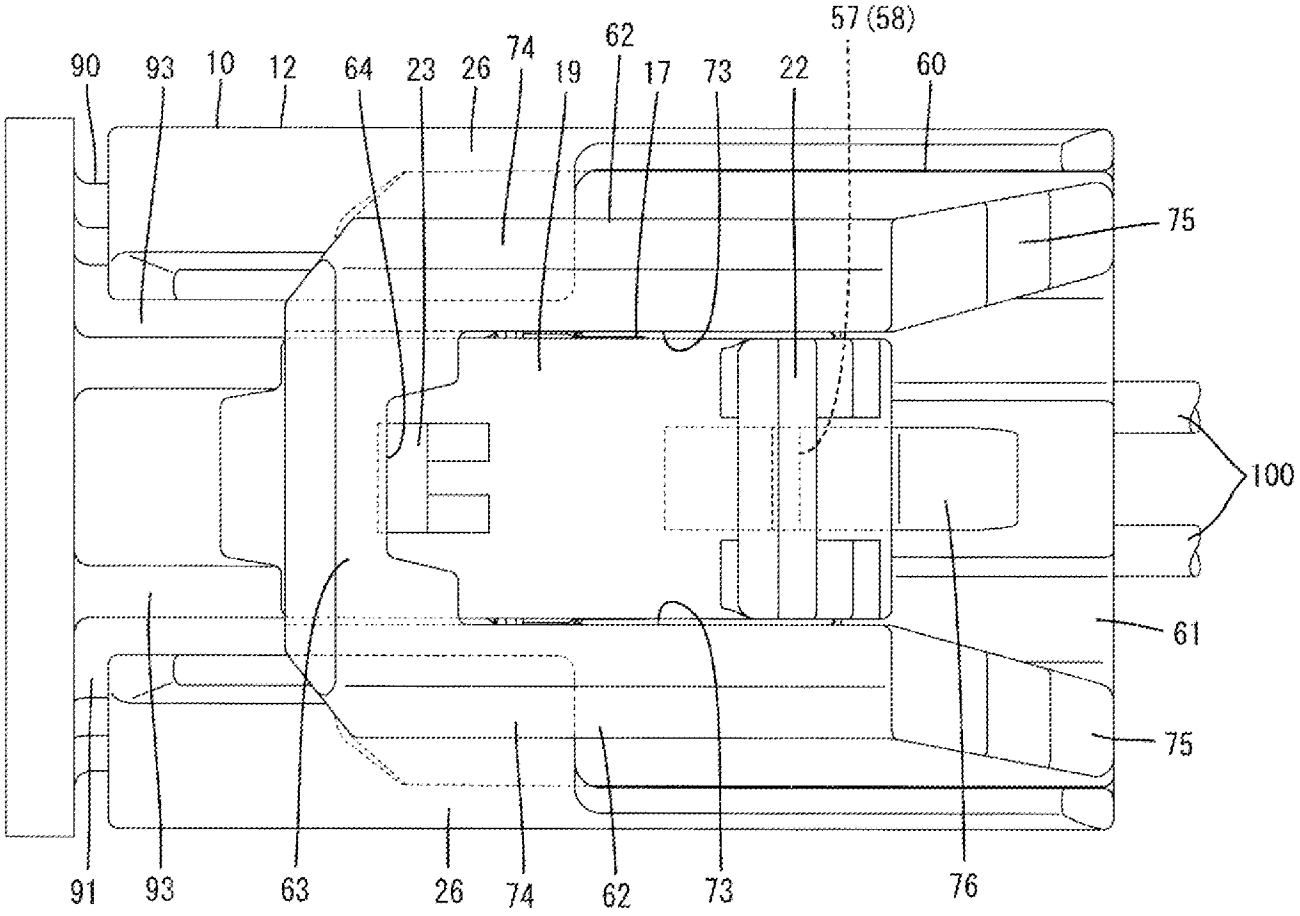
FIG. 7 is a section showing the state where the first and second housings are properly connected to each other.
Figure 10:
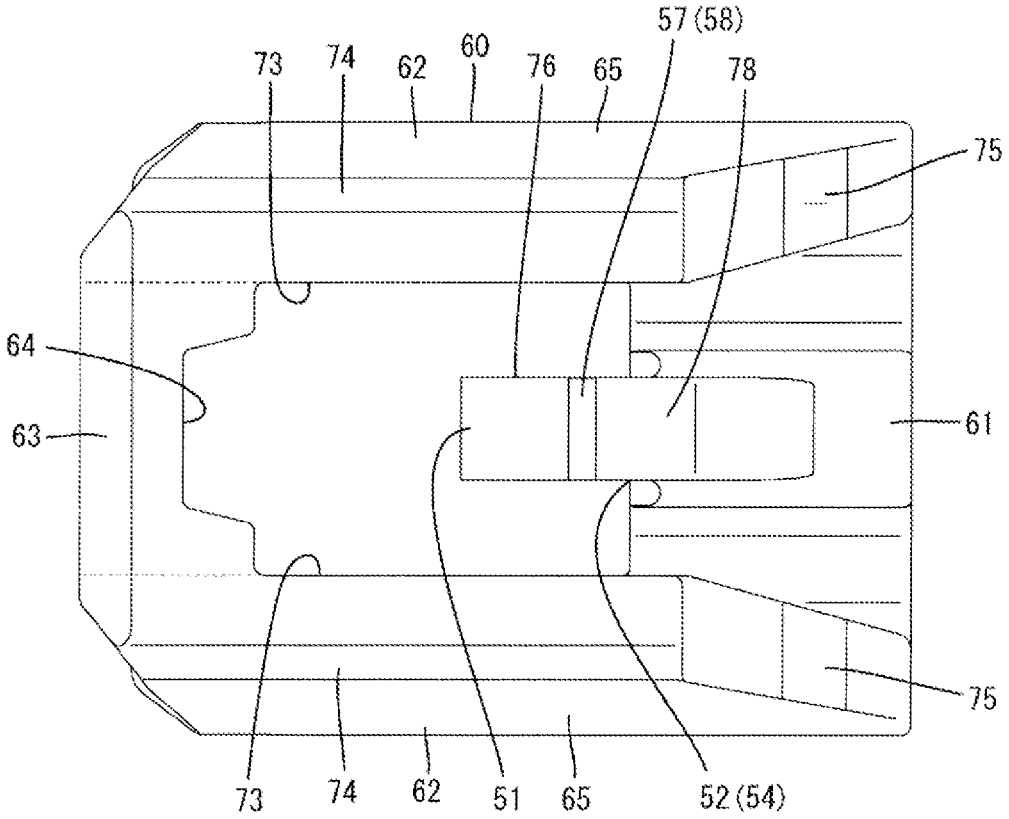
FIG. 10 is a plan view of the slider.

The coupling portion 63 is located above the base portion 61 and arranged in an offset manner so as not to overlap the base portion 61 in a plan view as shown in FIG. 10. Further, as shown in FIG. 10, a retaining/receiving portion 64 substantially in the form of a rectangular recess is formed in a widthwise central part of the rear end of the coupling portion 63. As shown in FIG. 7, when the slider 60 is at the retracted position, the retaining portion 23 of the lock arm 17 is inserted into the retaining/receiving portion 64 to rest thereon.

Figure 11:
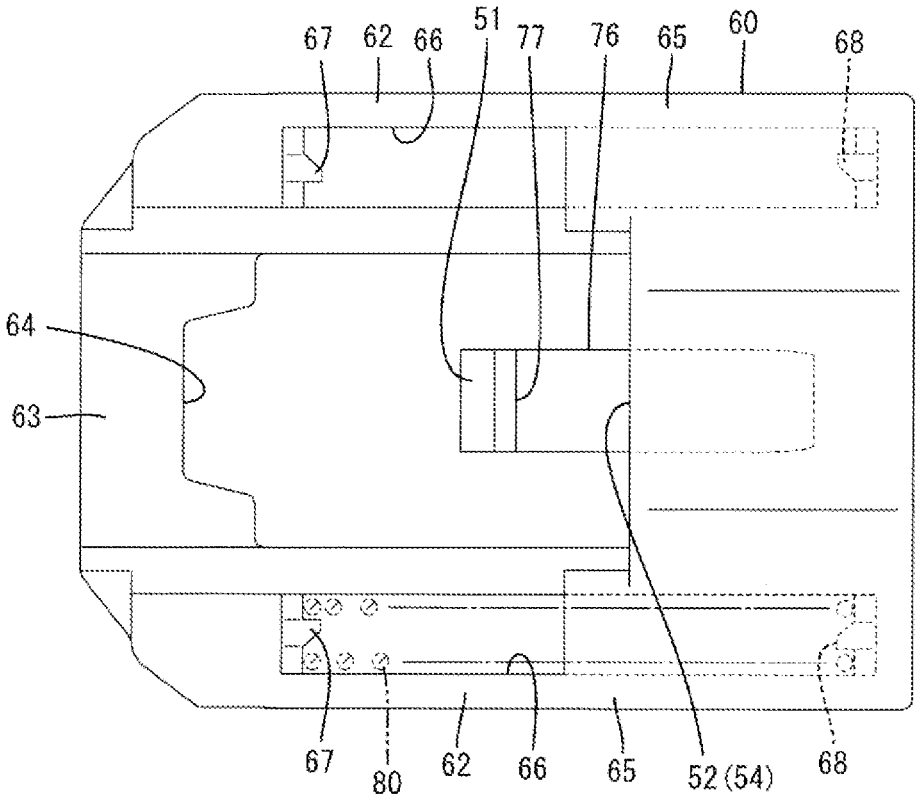
FIG. 11 is a bottom view of the slider.

As shown in FIG. 11, the spring accommodating portions 65 capable of accommodating the spring members 80 are formed below the both arm portions 62. Note that the spring member 80 is formed by a known spring such as a compression coil spring and resiliently expandable and contractible in the front-back direction.

Figure 13:
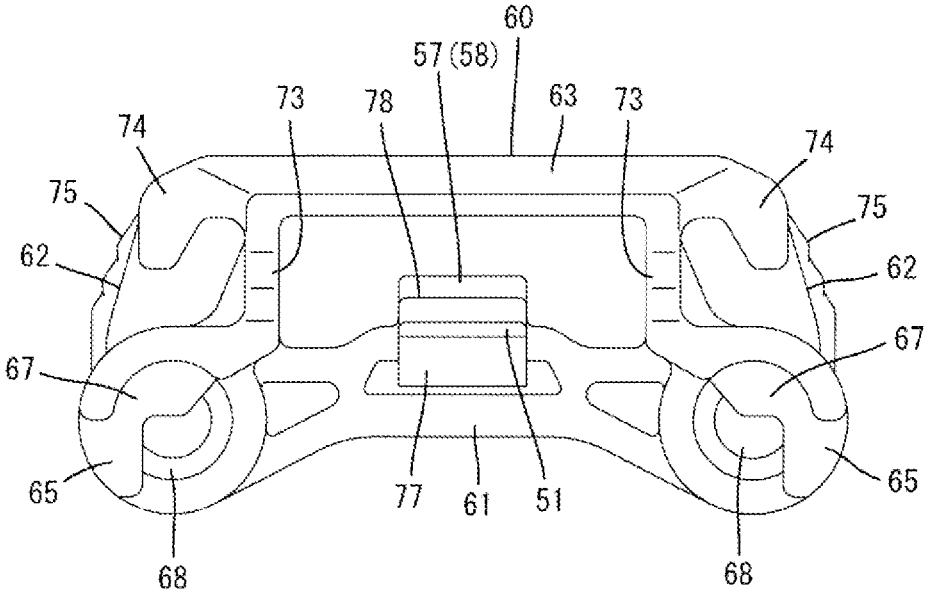
FIG. 13 is a front view of the slider.

The spring accommodating portion 65 is formed into a substantially hollow cylindrical shape and the spring member 80 can be entirely accommodated therein. As shown in FIG. 11, the spring accommodating portion 65 includes first and second spring receiving portions 67, 68 on front and rear sides for receiving and supporting opposite front and rear ends of the spring member 80. As shown in FIG. 13, the first and second spring receiving portions 67, 68 are arranged at positions not overlapping each other in a front view in consideration of the removal of a forming mold for the slider 60 in the front-back direction. Further, as shown in FIG. 11, an opening portion 66 open inward and downward is formed in a front part of the spring accommodating portion 65.

When the spring member 80 is mounted into the spring accommodating portion 65 as shown in FIG. 8, a lower part of the front end of the spring member 80 is arranged in an exposed manner below the first spring receiving portion 67. This causes the pressing portions 94 of the second housing 90 to be introduced into the opening portions 66 while pushing the lower parts of the front ends of the spring members 80 in the process of connecting the first and second housings 10, 90. Further, the second spring receiving portion 68 can receive a spring force of the spring member 80 by coming into contact with the lower part of the front end of the spring member 80.

As shown in FIG. 13, the both arm portions 62 are formed with a pair of protection walls 73 standing substantially vertically upward from the spring accommodating portions 65. In the case of assembling the slider 60 with the first housing 10, the both protection walls 73 are located to cover opposite widthwise ends of the lock arm 17.

Further, as shown in FIG. 13, a pair of guide main bodies 74 capable of guiding a movement of the slider 60 are formed on upper end parts of the both arm portions 62. The guiding main bodies 74 have such a substantially arcuate cross-section as to protrude outwardly from the upper ends of the both protection walls 73 and then hang downwardly. When the slider 60 is assembled with the first housing 10, the guide ribs 31 are fitted and inserted into between the guiding main bodies 74 and the protection walls 73 as shown in FIG. 8. In the process of moving the slider 60, the guide ribs 31 slide on the guiding main bodies 74 and the protection walls 73, thereby guiding a movement of the slider 60.

Figure 12:
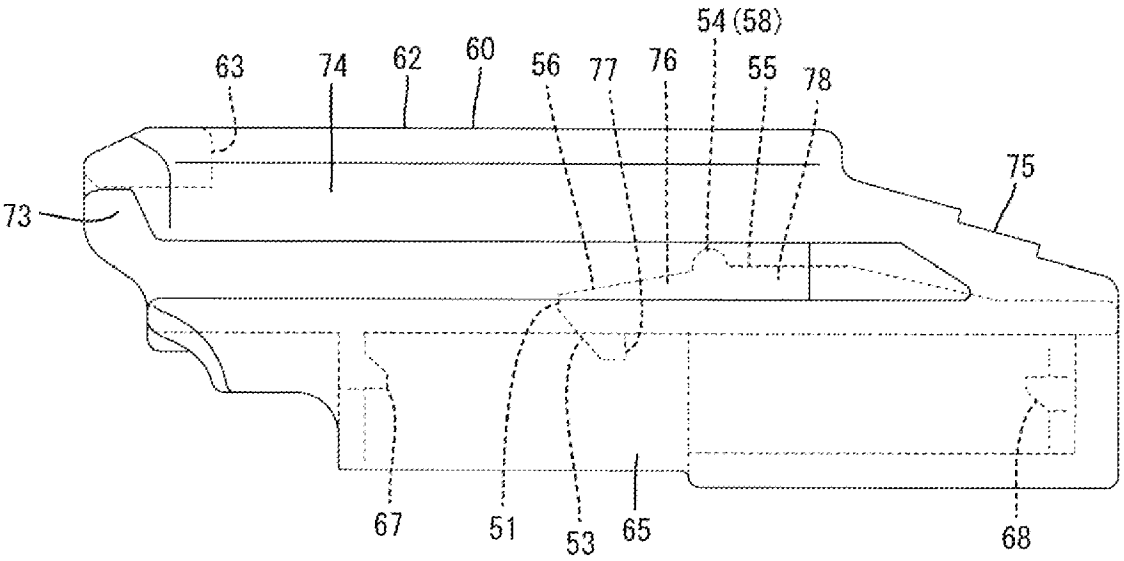
FIG. 12 is a side view of the slider.

Further, as shown in FIG. 12, push-in portions 75 inclined upwardly in a step-like manner from the rear end toward a front side are formed on the rear ends of the both arm portions 62. The push-in portions 75 are pressed forward, whereby the slider 60 can be moved toward the advanced position.

The resilient stopper 76 capable of regulating a movement of the slider 60 to the retracted position is deflectably formed on the base portion 61. As shown in FIG. 10, the resilient stopper 76 is cantilevered forward from a widthwise central part of the upper surface of the base portion 61. As shown in FIGS. 11 and 12, the locking projection 77 is formed to project downward on the tip portion 51 (front end part) of the resilient stopper 76. As shown in FIG. 1, the locking projection 77 is hooked and locked to the stopper receiving portion 25 when the slider 60 is at the advanced position. Further, an inclined surface 53 inclined obliquely downwardly is formed on the front surface of the tip portion 51 of the resilient stopper 76.

A base end portion 52 of the resilient stopper 76 is formed as a first supporting point portion 54 integrally coupled to the widthwise central part of the upper surface of the base portion 61 and serves as an initial supporting point of deflection when the resilient stopper 76 starts to be deflected in the process of connecting the first and second housings 10, 90 as described later.

Further, the resilient stopper 76 includes a base-like thickened portion 78 formed by gradually increasing a thickness of an upper part from the base end portion 52 (first supporting point portion 54) to a substantially central area in the front-back direction. As shown in FIG. 12, the upper surface of the thickened portion 78 has a flat surface 55 arranged substantially horizontally and a slant 56 inclined downwardly toward the front from the front end of the flat surface 55 when the resilient stopper 76 is in a natural state.

As shown in FIG. 12, the protrusion 57 is provided to project on a boundary part between the flat surface 55 and the slant 56 on the upper surface of the thickened portion 78 of the resilient stopper 76. The protrusion 57 is in the form of a rib extending in the width direction on the upper surface of the resilient stopper 76 as shown in FIG. 10 and has a substantially semicircular cross-section as shown in FIG. 12. As shown in FIG. 4, the protrusion 57 comes into contact with the bottom surface of the recess 41 located near an arm supporting point of the lock arm 17 immediately before the first and second housings 10, 90 are properly connected and this contact position forms a supporting point of deflection of the resilient stopper 76 as a second supporting point portion 58 instead of the first supporting point portion 54.

The structure of the connector of this embodiment is as described above. Next, an assembling method and a connecting operation of the connector are described.

First, the spring members 80 are accommodated into the spring accommodating portions 65 of the slider 60. The spring members 80 are inserted into the spring accommodating portions 65 through the opening portions 66. Then, the front ends of the spring members 80 are supported on the first spring receiving portions 67 and the rear ends of the spring members 80 are supported on the second spring receiving portions 68.

Subsequently, the slider 60 is inserted into the guide space 27 of the first housing 10 from behind. In the process of inserting the slider 60, the base portion 61 is located in the deflection space 42 below the releasing portion 22 of the lock arm 17, the protection walls 73 enter clearances between the guide walls 26 and the lock arm 17, and the coupling portion 63 is located above the arm main body 19. When the slider 60 is properly assembled, the resilient stopper 76 passes through the through hole 24 and, as shown in FIG. 1, the locking projection 77 is arranged to be lockable to the stopper receiving portion 25 to prevent a backward detachment of the slider 60. Further, when the slider 60 is properly assembled, the front ends of the spring accommodating portions 65 are arranged to be able to come into contact with the stopper walls 32 to regulate a forward displacement of the slider 60. In this way, the slider 60 is held at the advanced position with respect to the first housing 10 with forward and backward movements thereof regulated.

Note that the front and rear ends of the spring members 80 are supported on the first and second spring receiving portions 67, 68 when the slider 60 is at the advanced position. Further, at the advanced position, the protrusion 57 is located before the releasing portion 22 of the lock arm 17, thereby enabling the deflection of the lock arm 17.

Subsequently, the receptacle 91 of the second housing 90 is fitted into the connection space 13 of the first housing 10. In the connecting process, the pressing portions 94 of the second housing 90 enter the spring accommodating portions 65 to come into contact with the lower parts of the front ends of the spring members 80. As the connection further progresses, the front ends of the spring members 80 are pressed by the pressing portions 94 to be separated from the first spring receiving portions 67 and the spring members 80 are resiliently compressed while being supported on the second spring receiving portions 68. During this time, the spring members 80 accumulate their spring forces while applying the spring forces to the slider 60.

Further, as shown in FIG. 2, the releasing portion 96 of the second housing 90 comes into contact with the tip portion 51 of the resilient stopper 76 and slides on the inclined surface 53 in a final stage of the connecting process of the first and second housings 10, 90 and, associated with that, the resilient stopper 76 is deflected and deformed with the first supporting point portion 54 as a supporting point. At this time, the protrusion 57 is separated from the arm main body of the lock arm 17 and the entire resilient stopper 76 is not in contact with the lock arm 17.

As the connection further progress to reach a stage immediately before the first and second housings 10, 90 are properly connected, the protrusion 57 comes into contact with the bottom surface of the recess 41 of the lock arm 17 as shown in FIG. 3. As the connection progresses, the resilient stopper 76 is deflected and deformed with the second supporting point portion 58 at this contact position as a supporting point as shown in FIG. 4. That is, the supporting point of deflection of the resilient stopper 76 transitions from the first supporting point portion 54 to the second supporting point portion 58. In this case, since a separation distance between the second supporting point portion 58 and the tip portion 51 is shorter than that between the first supporting point portion 54 and the tip portion 51, a reaction force of the resilient stopper 76 is larger than when the first supporting point portion 54 functions as a supporting point while the second supporting point portion 58 functions as a supporting point.

Further, since being in contact with the lock arm 17 at the position near the arm supporting point portion 18, the protrusion 57 is substantially not affected by the deflection of the lock arm 17. That is, since the protrusion 57 is in contact with a part of the lock arm 17 which is substantially not deflected or deformed, the set position of the second supporting point portion 58 is precisely defined. Note that as the connection of the first and second housings 10, 90 progresses and the supporting point of deflection of the resilient stopper 76 transitions from the first supporting point portion 54 to the second supporting point portion 58, a locking margin between the locking projection 77 of the resilient stopper 76 and the stopper receiving portion 25 gradually decreases.

Thereafter, when the first and second housings 10, 90 reach a proper connection position, the lock arm 17 is resiliently locked to the lock portion 92 and the first and second housings 10, 90 are retained and held as shown in FIG. 5. Simultaneously, the first and second terminal fittings 20, 99 are properly connected to each other.

Further, when the first and second housings 10, 90 reach the proper connection position, locking between the locking projection 77 of the resilient stopper 76 and the stopper receiving portion 25 is released. Associated with that, the spring forces accumulated in the spring members 80 are released and the spring members 80 are going to return to a natural state. According to such returning movements of the spring members 80, the second spring receiving portions 68 of the slider 60 are pressed by the spring members 80 and the entire slider 60 is moved backward.

In the process of moving the slider 60, the spring accommodating portions 65 slide on the inner surfaces of the guide walls 26 and the guide ribs 31 slide on the protection walls 73 and the guiding main bodies 74, thereby guiding the movement of the slider 60. When the slider 60 reaches the retracted position as shown in FIG. 5, the spring members 80 substantially return to the natural state and the retaining portion 23 of the lock arm 17 comes into contact with the retaining/receiving portion 64 of the slider 60, thereby regulating any further retracting movement of the slider 60. By visually confirming that the slider 60 has reached the retracted position in this way, it can be known that the first and second housings 10, 90 are in a properly connected state.

When the slider 60 is at the retracted position, the protrusion 57 is located in the deflection space 42 on the side of the releasing portion 22 of the lock arm 17 and arranged in proximity to the lower surface of the lock arm 17 on the side of the releasing portion 22 as shown in FIG. 5. Even if an external matter (including a finger) accidentally comes into contact with the releasing portion 22 of the lock arm 17 from above in this state, the lock arm 17 comes into contact with the protrusion 57, whereby any further deflection is regulated and the releasing portion 22 is not inadvertently operated for unlocking.

On the other hand, if the connecting operation is stopped before the first and second housings 10, 90 reach the properly connected state, the pressing portions 94 are pushed back by the spring forces of the spring members 80 accumulated in the connecting process and the first and second housings 10, 90 are separated from each other. This prevents the first and second housings 10, 90 from being left in an incompletely connected state.

Further, in separating the first and second housings 10, 90 from each other for maintenance or the like, the push-in portions 75 of the slider 60 are first pressed with fingers to push the slider 60 forward. Then, the spring members 80 are resiliently compressed and the pressing portions 94 are pressed by the spring members 80. As the slider 60 moves forward, the protrusion 57 is retracted from its position below the releasing portion 22 and the deflection of the lock arm 17 is permitted. If the releasing portion 22 is pressed to lift up the front end part of the lock arm 17 in that state, the lock projection 21 is separated from the lock portion 92. As the locking state of the lock arm 17 is released in this way, the spring members 80 press the pressing portions 94 forward and the first housing 10 is separated from the second housing 90 by those pressing forces (spring forces).

As described above, according to this embodiment, the resilient stopper 76 includes the first and second supporting point portions 54, 58, the first supporting point portion 54 is configured on the base end portion 52 of the resilient stopper 76 and the second supporting point portion 58 is configured by the protrusion 57 formed closer to the tip side than the base end portion 52 of the resilient stopper 76. Thus, the reaction force of the resilient stopper 76 is larger than when the supporting point of deflection of the resilient stopper 76 is configured only by the first supporting point portion 54 since the resilient stopper 76 includes the second supporting point portion 58.

Further, in increasing the reaction force of the resilient stopper 76, the enlargement of the resilient stopper 76 cannot be avoided if the supporting point of deflection of the resilient stopper 76 is configured only by the second supporting point portion 58. However, in the case of this embodiment, the supporting point of deflection of the resilient stopper 76 is configured by both the first supporting point portion 54 and the second supporting point portion 58. Thus, the resilient stopper 76 needs not be enlarged in a part where the first supporting point portion 54 is caused to function. Therefore, the entire resilient stopper 76 needs not be enlarged and, consequently, the enlargement of the connector can be avoided.

In addition, since the second supporting point portion 58 is configured by the protrusion 57, the structure of the resilient stopper 76 does not become particularly complicated. Further, in the process of connecting the first and second housings 10, 90, the protrusion 57 is separated from the lock arm 17 except immediately before the properly connected state is reached. Thus, an increase of connection resistance is suppressed and operability at the time of connector connection can be improved.

Further, since the deflection of the lock arm 17 is regulated by the protrusion 57 when the first and second housings 10, 90 are in the properly connected state, it is prevented that the first and second housings 10, 90 are inadvertently separated.

Furthermore, since the protrusion 57 comes into contact with the lock arm 17 at the position near the arm supporting point portion 18 in configuring the second supporting point portion 58, a positional variation of the lock arm 17 can be small and the second supporting point portion 58 can be easily formed as compared with the case where the protrusion 57 comes into contact with the lock arm 17 at the position distant from the arm supporting point portion 18.

The present invention is not limited to the above described and illustrated embodiment. For example, the following modes are also included in the technical scope of the present invention.

The spring members may be interposed between the first housing and the slider.

The second supporting point portion may be configured on a tip part of the thickened portion and the protrusion may be integrated with the thickened portion without any distinction in shape.

A locking recess may be formed on the tip portion of the resilient stopper instead of the locking projection and the stopper receiving portion may be not in the form of a recess, but in the form of a projection hookable to the locking recess.

LIST OF REFERENCE SIGNS

10 . . . first housing
11 . . . housing main body
17 . . . lock arm
25 . . . stopper receiving portion
42 . . . deflection space
51 . . . tip portion

52 . . . base end portion
54 . . . first supporting point portion
57 . . . protrusion
58 . . . second supporting point portion
60 . . . slider
76 . . . resilient stopper
80 . . . spring member
90 . . . second housing
91 . . . receptacle
92 . . . lock portion
96 . . . releasing portion

The invention claimed is:

1. A connector, comprising:

a second housing including a releasing portion;

a first housing having a front end connectable to the second housing and a rear end opposite the front end and including a stopper receiving portion;

a slider assembled with the first housing movably between an advanced position and a retracted position rearward of the advanced position, the slider including a resilient stopper resiliently lockable to the stopper receiving portion and configured such that the slider is kept at the advanced position by locking of the resilient stopper and the stopper receiving portion in a process of connecting the first and second housings and such that the resilient stopper is deflected and deformed in a direction to release locking with the stopper receiving portion by being engaged with the releasing portion as the first and second housings are properly connected, thereby permitting a movement to the retracted position; and a spring member configured to accumulate a spring force while applying the spring force to the slider kept at the advanced position in the process of connecting the first and second housings and to move the slider toward the retracted position by a release of the spring force as the first and second housings are properly connected, wherein:

the resilient stopper is cantilevered from a base end portion toward a tip portion and the tip portion has a locking projection on a side of the resilient stopper facing toward the stopper receiving portion so that the locking projection is lockable to the stopper receiving portion; and the base end portion of the resilient stopper defines a first supporting point of deflection at a start of deflection in the process of connecting the first and second housings and a second supporting point of deflection between the tip portion and the base end portion and on a side of the resilient stopper opposite the locking projection, the resilient stopper deflecting about the second supporting point of deflection after an initial deflection of the resilient stopper about the first supporting point of deflection at the start of deflection in the process of connecting the first and second housings.

2. The connector of claim 1, wherein the second supporting point of deflection is a protrusion projecting on the resilient stopper.

3. The connector of claim 2, wherein the second housing includes a lock portion, the first housing includes a lock arm resiliently lockable to the lock portion when the first and second housings are properly connected, and the protrusion is separated from the lock arm when the resilient stopper starts to be deflected in the process of connecting the first and second housings and comes into contact with the lock arm to form the second supporting point of deflection immediately before the first and second housings reach a properly connected state.

4. The connector of claim 3, wherein a rear end part of the lock arm is pushed down toward a deflection space to release the connected state of the first and second housings, and the protrusion regulates deflection of the lock arm by entering the deflection space adjacent the rear end part of the lock arm when the slider is at the retracted position.

5. The connector of claim 4, wherein the lock arm is in the form of a cantilever configured to be deflected and deformed with an arm supporting point portion as a supporting point, and the protrusion comes into contact with the lock arm at a position near the arm supporting point portion to form the second supporting point of deflection.

6. The connector of claim 3, wherein the lock arm is in the form of a cantilever configured to be deflected and deformed with an arm supporting point portion as a supporting point, and the protrusion comes into contact with the lock arm at a positon near the arm supporting point portion to form the second supporting point of deflection.

7. A connector, comprising:

a first housing including a main body with a stopper receiving portion, a lock arm resiliently deflectably supported at a position spaced out from the main body;

a second housing having a front end that is connectable to the first housing, a releasing portion formed at the front end of the second housing, a lock formed on the second housing and being releasably locked with the lock arm of the first housing when the first and second housing reach a properly connected state;

a spring mounted to the first housing; and a slider assembled at least partly between the main body and the lock arm of the first housing, the slider being movable between an advanced position and a retracted position rearward of the advanced position on the first housing and being biased toward the retracted position by the spring, the slider including a resilient stopper with a base end and being cantilevered forward from the base end to a front end, the resilient stopper being configured for releasably locking the stopper receiving portion to hold the slider at the advanced position and against forces exerted by the spring, the front end of the resilient stopper being configured for engaging the releasing portion of the second housing as the first and second housings are connected properly so that the resilient stopper is deflected away from the stopper receiving portion, thereby enabling the spring to move the slider to the retracted position, and a protrusion between the base end and the front end of the resilient stopper, the protrusion engaging the lock arm after an initial deflection of the resilient stopper about the base end so that the base end and the protrusion define first and second sequential supports for deflection of the resilient stopper away from the stopper receiving portion.

* * * * *